US011248432B2

(12) United States Patent
Skjold et al.

(10) Patent No.: US 11,248,432 B2
(45) Date of Patent: Feb. 15, 2022

(54) METHOD AND APPARATUS FOR SUSPENDING A WELL

(71) Applicant: ICON Instruments AS, Sandnes (NO)

(72) Inventors: Jan Erik Skjold, Stavanger (NO); Kåre Olav Krogenes, Haugesund (NO)

(73) Assignee: ICON Instruments AS, Sandnes (NO)

( * ) Notice: Subject to any disclaimer, the term of this patent is extended or adjusted under 35 U.S.C. 154(b) by 0 days.

(21) Appl. No.: 16/611,917

(22) PCT Filed: May 11, 2018

(86) PCT No.: PCT/NO2018/050122

§ 371 (c)(1),
(2) Date: Nov. 8, 2019

(87) PCT Pub. No.: WO2018/208171

PCT Pub. Date: Nov. 15, 2018

(65) Prior Publication Data

US 2021/0079750 A1 Mar. 18, 2021

(30) Foreign Application Priority Data

May 11, 2017 (NO) ..... 20170771
Apr. 30, 2018 (NO) ..... 20180620

(51) Int. Cl.
*E21B 33/124* (2006.01)
*E21B 47/12* (2012.01)
(Continued)

(52) U.S. Cl.
CPC ..... *E21B 33/03* (2013.01); *E21B 33/134* (2013.01); *E21B 47/07* (2020.05); *E21B 47/13* (2020.05); *E21B 47/14* (2013.01)

(58) Field of Classification Search
CPC ..... E21B 33/03; E21B 33/04; E21B 33/0407; E21B 33/047; E21B 23/00; E21B 23/08; E21B 33/124; E21B 34/06; E21B 47/12
See application file for complete search history.

(56) References Cited

U.S. PATENT DOCUMENTS 4,206,810 A * 6/1980 Blackman ..... E21B 47/14 166/336
4,460,039 A 7/1984 Knight
(Continued)

FOREIGN PATENT DOCUMENTS

WO 2015054020 4/2015
WO 2016200266 12/2016

OTHER PUBLICATIONS

Norwegian Search Report for 20170771, dated Oct. 31, 2017.
(Continued)

*Primary Examiner* — Kenneth L Thompson
(74) *Attorney, Agent, or Firm* — Andrus Intellectual Property Law, LLP

(57) ABSTRACT

A method is for suspending flow in a well. The method includes placing a first plug in a production tubular in an upper wellhead section, above a downhole safety valve. The first plug is adapted to fit into the production tubular to form a fluid seal in the production tubular to form a barrier for containing well fluid; equipped with instrumentation for obtaining information by measuring physical characteristics below the plug; and equipped with means for transmitting said obtained information to an operator. There is also described an apparatus for suspending flow in the well.

25 Claims, 7 Drawing Sheets

(51) Int. Cl.

| | |
|---|---|
| ***E21B 33/03*** | (2006.01) |
| ***E21B 47/13*** | (2012.01) |
| ***E21B 47/07*** | (2012.01) |
| ***E21B 33/134*** | (2006.01) |
| ***E21B 47/14*** | (2006.01) |

(56) References Cited

U.S. PATENT DOCUMENTS

| | | | | |
|---|---|---|---|---|
| 6,597,175 | B1 * | 7/2003 | Brisco | E21B 33/05 324/326 |
| 8,789,582 | B2 * | 7/2014 | Rondeau | E21B 33/16 166/153 |
| 9,911,016 | B2 * | 3/2018 | Ownby | G06K 7/10316 |
| 10,100,612 | B2 * | 10/2018 | Lisowski | E21B 17/046 |
| 10,240,448 | B2 * | 3/2019 | Kuehl | E21B 43/26 |
| 2005/0028980 | A1 | 2/2005 | Page et al. | |
| 2008/0277122 | A1 | 11/2008 | Tinnen et al. | |
| 2012/0037374 | A1 | 2/2012 | Schuurman et al. | |
| 2013/0014958 | A1 | 1/2013 | Jani | |
| 2013/0133883 | A1 | 5/2013 | Hill, Jr. | |
| 2015/0204155 | A1 | 7/2015 | Patel | |
| 2015/0361757 | A1 | 12/2015 | Bennett et al. | |
| 2016/0251931 | A1 | 9/2016 | Buchan et al. | |
| 2017/0335678 | A1 * | 11/2017 | Ciezobka | E21B 33/12 |

OTHER PUBLICATIONS

Norwegian Search Report for 20180620, dated Nov. 26, 2018.
International Search Report and the Written Opinion for PCT/NO2018/050122, dated Oct. 25, 2018.
Response to the Written Opinion for PCT/NO2018/050122, dated Mar. 11, 2019.
Written Opinion for PCT/NO2018/050122, dated Jul. 3, 2019.
Response to the Written Opinion for PCT/NO2018/050122, dated Aug. 2, 2019.
International Preliminary Report on Patentability for PCT/NO2018/050122, dated Aug. 7, 2019.

* cited by examiner

METHOD AND APPARATUS FOR SUSPENDING A WELL

CROSS-REFERENCE TO RELATED APPLICATIONS

This application is the U.S. national stage application of International Application PCT/NO2018/050122, filed May 11, 2018, which international application was published on Nov. 15, 2018, as International Publication WO 2018/208171 in the English language. The International Application claims priority of Norwegian Patent Application Nos. 20170771, filed May 11, 2017 and 20180620 filed Apr. 30, 2018. The international application and Norwegian applications are all incorporated herein by reference, in entirety.

FIELD OF INVENTION

The present invention relates to suspending flow in a completed well. More particularly, in a first aspect, the invention relates to a method of suspending flow in a well by setting a plug comprising means for obtaining information by measuring a fluid characteristic of a fluid in a chamber in the well and means for transmitting said information to an operator. Suspension of a well may be required for a number of reasons, e.g. for temporary abandonment, or for servicing or replacement of a Christmas tree.

BACKGROUND

Current practice utilised in the oil and gas industry makes use of a deep set mechanical bridge plug set close by the producing formation complimented by an inflow tested downhole safety valve, which in combination with a drop protection device is considered acceptable providing the downhole safety valve exhibits zero leakage. It is however common that a downhole safety valve exhibits some leakage and, in such case, a shallow set mechanical bridge plug or tubing hanger plug is required in addition to the deep set mechanical bridge plug to achieve acceptable barrier protection. Current practice is thoroughly documented in NORSOK D-010 "Well integrity in drilling and well operations" which is in line with international standards and requirements such as described in relevant API and ISO publications (American Petroleum Institute, International Organization for Standardization) and is only discussed briefly herein.

Further references to a plug, unless specifically stated otherwise may mean any type of mechanical plug, a bridge plug, a tubing hanger plug, a BPV plug set in a wellhead profile etc.

The procedure for setting and retrieving a deep-set plug requires the use of intervention equipment such as a wireline, a coiled tubing equipment assembly or drill pipe with associated handling equipment. Such equipment represents considerable cost, weight, volume, safety and handling issues. In some instances, such equipment may have to be mobilised from an offshore location representing significant safety and handling challenges both onshore and during lifting onto an offshore installation as well as during operation. Furthermore, the equipment may not be immediately available causing loss of production and revenue.

Setting and retrieving a deep-set plug is relatively time consuming and not without risk. Potential pressure differentials across a plug caused by changes in well pressure during a suspension period, needs to be equalised, or near equalised prior to initiating a controlled release and retrieval of a plug. Without means of detecting fluid characteristics below a plug, such as pressure, temperature or fluid composition, the pressure differential across a plug must be equalised by trial prior to release and retrieval. Commonly the pressure above a plug is set at an anticipated value before jarring or otherwise manipulating the plug until released, and if unsuccessful reducing/increasing the pressure and trying again, repeatedly if necessary until the plug is released. Significant mechanical force is applied in the process and the procedure may cause damage to the inner wall of the tubular and to the plug. In a worst instance it may not be possible to release the plug leading to it having to be removed by milling. In some instances, a pressure differential may be caused by changes to the static conditions of the well, such as thermal expansion, and the excess pressure may be bled off with little volume flow across the released plug. However, if a considerable portion of gas is trapped below the plug, releasing said gas may form an expanding gas volume migrating upwards in the production tubular. This represents a hazard that must be contained and disposed of prior to returning the well to its normal operating state.

Another aspect complicating setting of a plug is scale and/or wax deposits formed on the interior of a production tubular wall. Such deposits may impair or make it impossible to set a plug in place and obtain a pressure tight seal at a desired location and may require removal of the deposits prior to setting the plug. Such a deposit-removal operation at depth is far more complex and time consuming for a deep-set plug than for a shallow-set plug.

The invention has for its object to remedy or to reduce at least one of the drawbacks of the prior art, or at least provides a useful alternative to prior art. The object is achieved through features, which are specified in the description below and in the claims that follow. The invention is defined by the independent patent claims. The dependent claims define advantageous embodiments of the invention.

US20150204155A1 embodiments of dual barrier open water well completion systems.

The well suspension method disclosed employs at least one plug set in an upper wellhead region above a downhole safety valve. Through use of enhanced monitoring of the wellbore volumes the suspension method avoids use of any deep-set plug and subsequently any need for special, heavy equipment such as wireline, coiled tubing or drill pipe for setting and retrieval.

By using a shallow-set plug, and no deep-set plugs, the suspension method disclosed may make use of a commonly available lubricator tool such as described in U.S. Pat. No. 4,460,039 instead of the aforementioned specialized equipment. Thus, an operation carried out according to the disclosed method may be performed in shorter time requiring considerably less equipment with a higher degree of predictability and safety. Necessary wireline equipment typically consists of 5-10 lifts and weighs in excess of 50 tons while a lubricator tool typically consists of a single lift weighing less than 2 tons, making logistics, handling and operation simpler and safer. Due to reduced weight and size such lubricator tools may be stored offshore, ready for immediate use when needed while mobilisation of a wireline unit or equivalent equipment from an onshore location may require days, weeks or even months, representing vastly more cost and complexity.

A lubricator tool is a long, high-pressure pipe fitted to the top of a wellhead or Christmas tree so that tools may be put into a high-pressure well. The term wireline usually refers to cabling technology used by operators of oil and gas wells to lower equipment or measurement devices into the well for the purposes of well intervention, reservoir evaluation, pipe recovery and setting and retrieving plugs. A wireline unit includes an intervention blow out preventer with closing and shear rams as well as a lubricator section similar to that of a lubricator tool.

One important difference between a wireline unit and a lubricator tool is that while a lubricator tool may set and retrieve a shallow plug in the upper wellhead section typically limited to 5-10 metres from top of the Christmas tree where the setting depth depends upon the stroke length of the lubricator tool—a wireline unit may set and retrieve a plug at any depth in the well.

A Christmas tree is an assembly of valves, spools and fittings, adapted to fit on top of a wellhead.

Reduced equipment handling lowers the risk of accidents during shipping, handling and operation. In addition, performing well suspension by employing the method provides enhanced operational awareness and situation predictability, consequently leading to improved safety.

A deep-set plug is currently employed for well suspensions since it is, in some respects, desirable to place a first plug as close to the producing formation as possible thereby limiting the volume of fluid below the plug that may be susceptible to pressure change and/or to gas influx and subsequently the total volume of gas influx and gas contained below a plug. However, if exact information as to what is contained behind a plug is made available to an operator prior to bringing a well out of suspension, any required actions may be predicted, planned for and implemented when retracting a plug and bringing the well safely out from suspension into its normal operating conditions.

With information about the fluid characteristics of a fluid in a chamber below a plug, the volume of the fluid contained in the chamber below the plug has little or no significance and the location of the plug is also less important. Thus, placing the plug, or plugs, further away from the formation, i.e. higher up in the well, is feasible both from a technical, operational and safety viewpoint.

SUMMARY OF THE INVENTION

The invention provides a method for suspending a well by blocking the wellbore passage at a location in the upper wellhead instead of a location close to the producing formation. The method compensates for an increased risk associated with the increased fluid volume subject to contact with the producing formation by obtaining information by measuring physical characteristics of the fluid in the fluid volume and by making said information available to an operator. Advantageously, operational predictability and safety is increased by gathering information on the physical characteristics of the fluid and making the information available to the operator; and the amount of equipment and time required for a suspension operation is reduced by avoiding a deep-set plug.

According to a first aspect the invention, there is provided a method of suspending flow in a well, the method comprising the step of placing a first plug in a production tubular in an upper wellhead section, above a downhole safety valve, wherein the first plug is: adapted to fit into the production tubular to form a fluid seal in the production tubular to form a barrier for containing well fluid; equipped with instrumentation for obtaining information by measuring physical characteristics below the plug; and equipped with means for transmitting said obtained information to an operator.

A control unit may be used to communicate with the instrumentation of the first plug and to make the information transmitted from the plug available to an operator. The control unit may be located inside or outside of the tubular.

The well may be a completed well. The step of placing the first plug in the production tubular in the upper wellhead section of the well may comprise setting the plug in the upper wellhead section of a completed well. The well may be a producing well, and the method may typically be a way of suspending production flow in the well. The well may be an oil well, a gas well, a water injection well, a water disposal well, a gas injection well, a condensate well or another type of well.

The step of placing the first plug in a production tubular in an upper wellhead section may comprise setting the first plug in an upper wellhead section of a completed well.

The method may comprise the step of setting a second plug in the well to form a secondary barrier. The second plug may comprise instrumentation for obtaining information by measuring physical characteristics below the second plug. Furthermore, the second plug may comprise means for transmitting said information to an operator. Setting a second plug may be advantageous to establish two barriers in the well. The downhole safety valve may in some situations be an acceptable primary barrier, but in other situations it may not be. When the downhole safety valve is not accepted as a primary barrier, the second plug may be necessary to fulfil regulations regarding well integrity. The second plug may comprise instrumentation for obtaining information by measuring physical characteristics above the second plug.

One or both of the first plug and the second plug may comprise instrumentation for obtaining information by measuring physical characteristics above the plug. Measuring physical characteristics in several chambers in the well may be advantageous to provide information regarding e.g. leaks and pressure characteristics, which may be vital information to avoid serious incidents.

The method may comprise the step of obtaining information on the characteristics of a fluid in the well by use of the instrumentation for obtaining information. The method may comprise the step of obtaining information by use of the instrumentation for obtaining information of the first plug, or of the second plug or of the first and the second plug. The fluid may be a fluid below the first plug, between the first plug and the second plug, and/or above the second plug.

The method may comprise the step of transferring information from the first and/or the second plug to an operator, and/or the step of transferring information from an operator to the first and/or the second plug. The step of transferring information may be performed e.g. by use of means for acoustic signalling and/or by use of means for electromagnetic signalling. Other means may also be used for transferring information. Furthermore, the step of transferring information may comprise the step of lowering the control unit down the well towards the first and/or the second plug. The transfer of information may be performed by employing methods known from prior art, such as transferring information acoustically via a tubular.

By obtaining information on the physical characteristics of a fluid contained by a plug and making said information available to an operator, it is possible for the operator to predict results of actions taken during a process of retrieval of the plug. Having said information may remove or at least reduce a risk related to retrieval of the plug. As a result, a deep-set plug may be avoided by applying the method according to the invention. Avoiding a deep-set plug when suspending a well may save a lot of time and cost and reduce some negative risks related to a well-suspension operation.

The physical characteristics may include fluid pressure, fluid temperature, fluid density, fluid viscosity, fluid pH and/or fluid refractive index. The data obtained from measuring the physical characteristics may be used to determine a type of fluid. Enabling detection of fluid type may provide vital information. E.g. it may be possible to detect whether the fluid below a barrier is gas or liquid, and/or whether it is water or hydrocarbons.

A lubricator tool may be used to set the first and/or the second plug. Other intervention equipment may otherwise be used, such as a pipe, a wireline, or coiled tubing. Using the intervention equipment may advantageously provide a barrier in the form of the intervention equipment while installing the first and/or second plug.

The first and the second plug may be mechanically connected, which may allow for setting and/or retrieving the plugs to be performed in a single well entry operation. The first and second plug may be parts of an apparatus. The apparatus may be referred to as a tandem plug. The apparatus may further comprise a middle section with a smaller diameter. When the plugs are set as barriers in a tubular, the smaller-diameter middle section may allow a chamber comprising fluid to be formed in the tubular between the two plugs. The apparatus may comprise instrumentation for obtaining information by measuring physical characteristics below the lowermost plug, above the uppermost plug, and/or in the chamber between the two plugs when the apparatus is in operational use. The apparatus may further comprise means for transmitting said information to an operator.

The method may further comprise the step of installing one or more sensors for monitoring one or more annular volumes. For each annular volume, a sensor may be installed at an outlet leading to an annulus valve. When using a deep-set plug, the portion of the well where leak paths may occur between the production tubular and the annular volumes may be sealed off. As a deep-set plug is avoided by using the method according to the first aspect of the invention, said portion of the well may not be sealed off, and leak paths may occur. It may therefore be advantageous to install one or more sensors to detect and/or monitor a leak.

The method according to the first aspect of the invention may comprise one or more of the following steps:

- Shutting the well in by closing the downhole safety valve and all Christmas tree valves leading from the production tubular. A shutting of the downhole safety valve may be followed by a leak-off test ensuring the integrity of the downhole safety valve;
- Mounting a lubricator tool to the Christmas tree. The first plug may be assembled in the lubricator tool. Pressure testing may be performed if needed;
- Opening Christmas tree valves to allow the lubricator to access the production tubular. A pressure test may be performed if needed;
- Stroking the lubricator piston in to the production tubular and setting the first plug at a shallow location above the downhole safety valve;
- Establishing a primary barrier by use of the first plug;
- Assembling the second plug in the lubricator tool;
- Setting the second plug in the wall of the production tubular or in a tubing hanger profile;
- Establishing a secondary barrier by use of the second plug;
- Removing the intervention equipment when two barriers have been established;
- Monitoring one or more volumes having direct or indirect interface with at least one of the first and the second plug by use of instrumentation for measuring physical characteristics of a well fluid in said volumes;
- Mounting a lubricator tool to the Christmas tree to retrieve one or more plugs following an intervention procedure. Pressure testing if needed.
- Retrieving the second plug;
- Retrieving the first plug while maintaining double barriers at all times;
- Removing the lubricator tool; and/or
- Bringing the well back into production.

Furthermore, the method may comprise one or both of the following steps:

- Setting a tandem plug comprising a first and a second plug to establish two barriers in one operation; and
- Retrieving the tandem plug comprising the first and the second plug.

The method may apply to a surface application, and/or the method may apply to a subsea application. One of the significant features of the invention is that it allows for carrying out a well suspension operation without need to enter the well through an inflow-tested downhole safety valve, thereby allowing the safety valve to remain in position from initial preparations for well suspension until the well is brought into production again. Another significant feature is that the invention provides a method for suspending a well which does not involve deep entry into the well and thereby allows for use of equipment for setting plugs with limited ranged, such as a lubricator, instead of the type of equipment typically used in prior art, which may be heavier and more time-consuming to use. A further significant feature is that the invention may provide monitoring of all volumes enclosed by the production tubular.

According to a second aspect of the invention, there is provided an apparatus for suspending flow in a well, the apparatus comprising a first plug, the first plug comprising instrumentation for obtaining information by measuring physical characteristic in a well and means for transmitting said information to an operator. The apparatus may further comprise a second plug. The second plug may comprise instrumentation for obtaining information by measuring physical characteristics in a well and/or for transmitting said information to an operator. The means for transmitting information may be means for transmitting information acoustically, and/or means for transmitting magnetically.

The instrumentation for obtaining information by measuring physical characteristics of the first and/or the second plug may comprise instrumentation for obtaining information by measuring physical characteristics below the plug in operational use.

The first and the second plug of the apparatus may be mechanically connected. The apparatus may comprise a middle section, between the first and the second plug, comprising the mechanical connection between the first and the second plug. The middle section may be of a smaller diameter than the plugs and may be adapted to form a chamber in a tubular in operational use. The apparatus' means for obtaining information may be arranged to measure physical characteristics below the lowermost plug, above the uppermost plug, and/or between the two plugs, when installed in a production tubular, in operational use.

Having the first plug and the second plug be mechanically connected may be advantageous as it may make an installation and/or retrieval operation less time-consuming and more efficient. Having a middle section of smaller diameter that may form a chamber in the well when the apparatus is in operational use may be further advantageous as it may separate the two plugs and make them count as two separate barriers. Furthermore, the chamber may contain one or more fluids that may be monitored by the apparatus' means for obtaining information by measuring physical characteristics, which may be used to gather information regarding the barrier integrity of one or more of the plugs.

DESCRIPTION AND DRAWINGS

There will now be described, by way of example only, embodiments of the invention, with reference to the accompanying drawings, in which.

Figure 7:
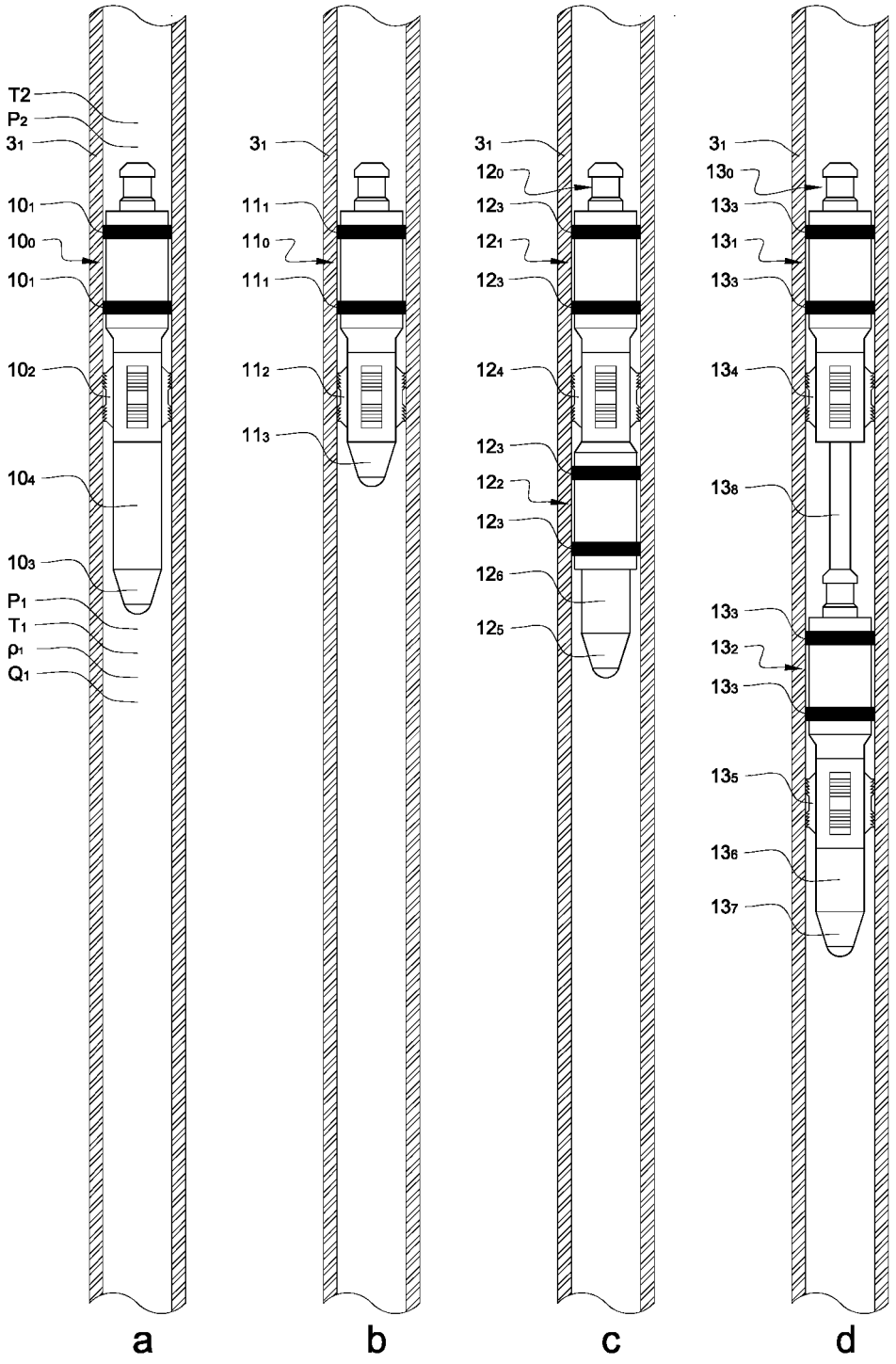

FIG. 7*a* illustrates an embodiment of a plug set in a production tubular of a well;

FIG. 7*b* illustrates another embodiment of a plug set in a production tubular of a well;

FIG. 7*c* illustrates an embodiment of a tandem plug set in a production tubular of a well; and FIG. 7*d* illustrates another embodiment of a tandem plug set in a production tubular of a well.

Figure 1:
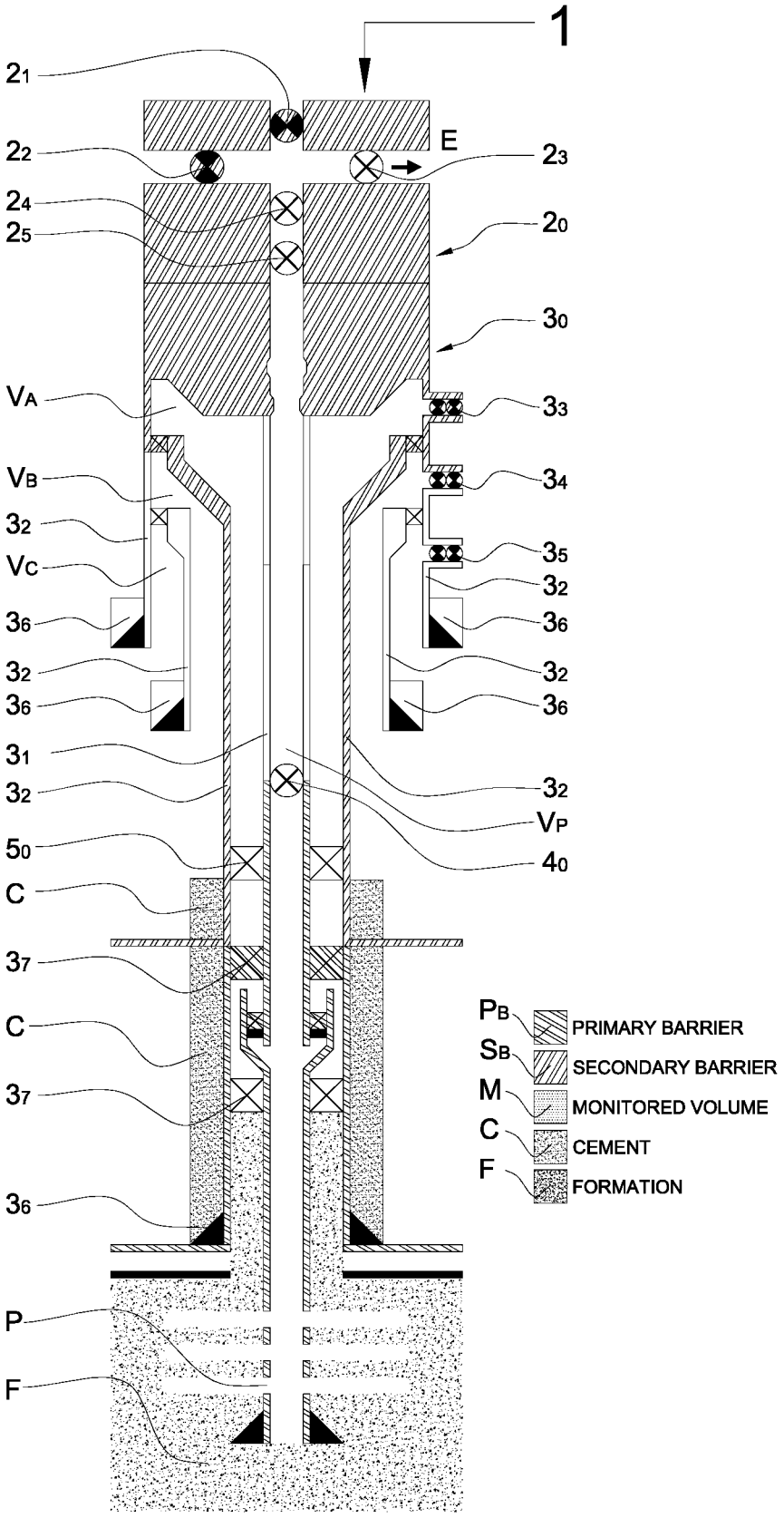
FIG. 1 shows a schematic representation of a production well in producing mode.

FIG. 1 shows a production well (1) in producing mode where there is fluidic connection between the hydrocarbon producing formation (F) and the outlet from a production master valve ($\mathbf{2}_3$). The well (1) comprises a downhole safety valve ($\mathbf{4}_0$), a manual master valve ($\mathbf{2}_5$), a hydraulic master valve ($\mathbf{2}_4$) and the production master valve ($\mathbf{2}_3$) that are all in an open position in this mode. The open valves allow for free flow of formation fluid from the formation (F), through the production tubular perforations, through a production tubular ($\mathbf{3}_1$) of the well (1), and through the open valves, to production. Furthermore, the well comprises a kill valve ($\mathbf{2}_2$) and a swab valve ($\mathbf{2}_1$) that are closed when the well (1) is in production mode.

The well (1) further comprises a wellhead ($\mathbf{3}_0$), equipped with a Christmas tree ($\mathbf{2}_0$). The Christmas tree ($\mathbf{2}_0$) comprises the production master valve ($\mathbf{2}_3$), hydraulic master valve ($\mathbf{2}_4$) and manual master valve ($\mathbf{2}_5$), and allows for closing production by closing one or more of said valves. The Christmas tree ($\mathbf{2}_0$) further comprises the kill valve ($\mathbf{2}_2$), and the swab valve ($\mathbf{2}_1$). Production can also be interrupted by opening the kill valve ($\mathbf{2}_2$) to divert flow of produced fluid from the formation (F) through the kill valve ($\mathbf{2}_2$). The swab valve ($\mathbf{2}_1$) allows for introduction of intervention equipment, e.g. for well suspension or reworking.

The production well (1) extends from the wellhead ($\mathbf{3}_0$) or, if mounted, the Christmas tree ($\mathbf{2}_0$), down to the producing formation (F) through a production tubular ($\mathbf{3}_1$) which at the hydrocarbon bearing formation (F) is perforated (P) to allow inflow of well fluids. The production tubular ($\mathbf{3}_1$) is contained within several casings ($\mathbf{3}_2$). The casings ($\mathbf{3}_2$) form annular volumes ($V_A$, $V_B$ and $V_C$) extending from the wellhead ($\mathbf{3}_0$) to casing shoes ($\mathbf{3}_6$) that are sealed towards the surrounding formation or to casing packers ($\mathbf{3}_7$) that are sealed towards the production tubular ($\mathbf{3}_1$) and cemented (C) towards the surrounding formation. Each annular volume ($V_A$, $V_B$ and $V_C$) is contained by annulus valves ($\mathbf{3}_3$, $\mathbf{3}_4$, and $\mathbf{3}_5$).

The downhole safety valve ($\mathbf{4}_0$) and an annular safety valve ($\mathbf{5}_0$) are arranged in the production tubular. The annular safety valve ($\mathbf{5}_0$) is arranged to close the annulus formed between the production tubular ($\mathbf{3}_1$) and the innermost casing ($\mathbf{3}_2$).

The production well (1) elements form two barriers isolating the formation (F) fluids from the surrounding environment (E). A primary barrier ($P_B$) is formed by the formation (F), cement (C), production tubular ($\mathbf{3}_1$), packers ($\mathbf{3}_7$) and downhole safety valve ($\mathbf{4}_0$). A secondary barrier ($S_B$) is formed by the primary barrier ($P_B$), casing ($\mathbf{3}_2$), cemented casing shoe ($\mathbf{3}_6$), annular safety valve ($\mathbf{5}_0$), wellhead ($\mathbf{3}_0$) and Christmas tree ($\mathbf{2}_0$) valves ($\mathbf{2}_1$, $\mathbf{2}_2$, $\mathbf{2}_3$, $\mathbf{2}_4$, and $\mathbf{2}_5$).

Figure 2:
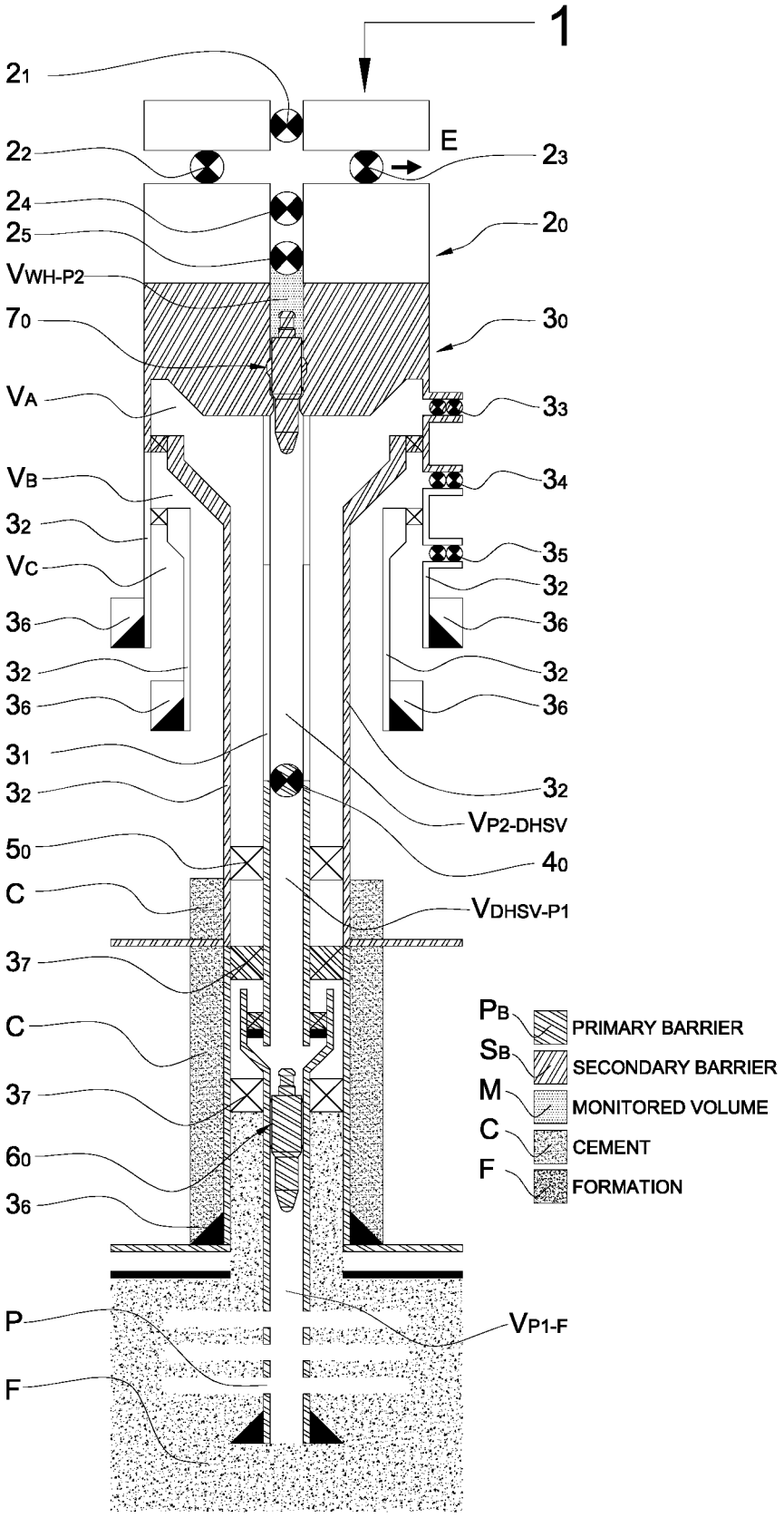
FIG. 2 shows a schematic representation of the production well having been suspended by setting a deep-set plug below a downhole safety valve and a shallow-set plug above the downhole safety valve, in accordance with prior art.

FIG. 2 shows the production well (1) having been suspended by setting a deep-set first plug ($\mathbf{6}_0$) below the downhole safety valve ($\mathbf{4}_0$), closing the downhole safety valve ($\mathbf{4}_0$) and setting a shallow-set second plug ($\mathbf{7}_0$) in the upper wellhead section above the downhole safety valve ($\mathbf{4}_0$). Furthermore, in this mode, the production master valve ($\mathbf{2}_3$), the hydraulic master valve ($\mathbf{2}_4$) and the manual master valve ($\mathbf{2}_5$) are all closed. Setting a deep plug requires intervention equipment capable of deep entry into the well, such as a wireline unit, a coiled tubing unit or drill pipe. By suspending the well in this manner, only a small section of the well, a first chamber ($V_{WH\text{-}P2}$) between the second plug and the manual master valve ($\mathbf{2}_5$) can typically be monitored. However, it may also be possible by use of a downhole pressure gauge or tubing-to-annulus communication to provide a pressure reading of a second chamber ($V_{DHSV\text{-}P1}$) of the well (1), between the deep-set first plug ($\mathbf{6}_0$) and the downhole safety valve.

Figure 3:
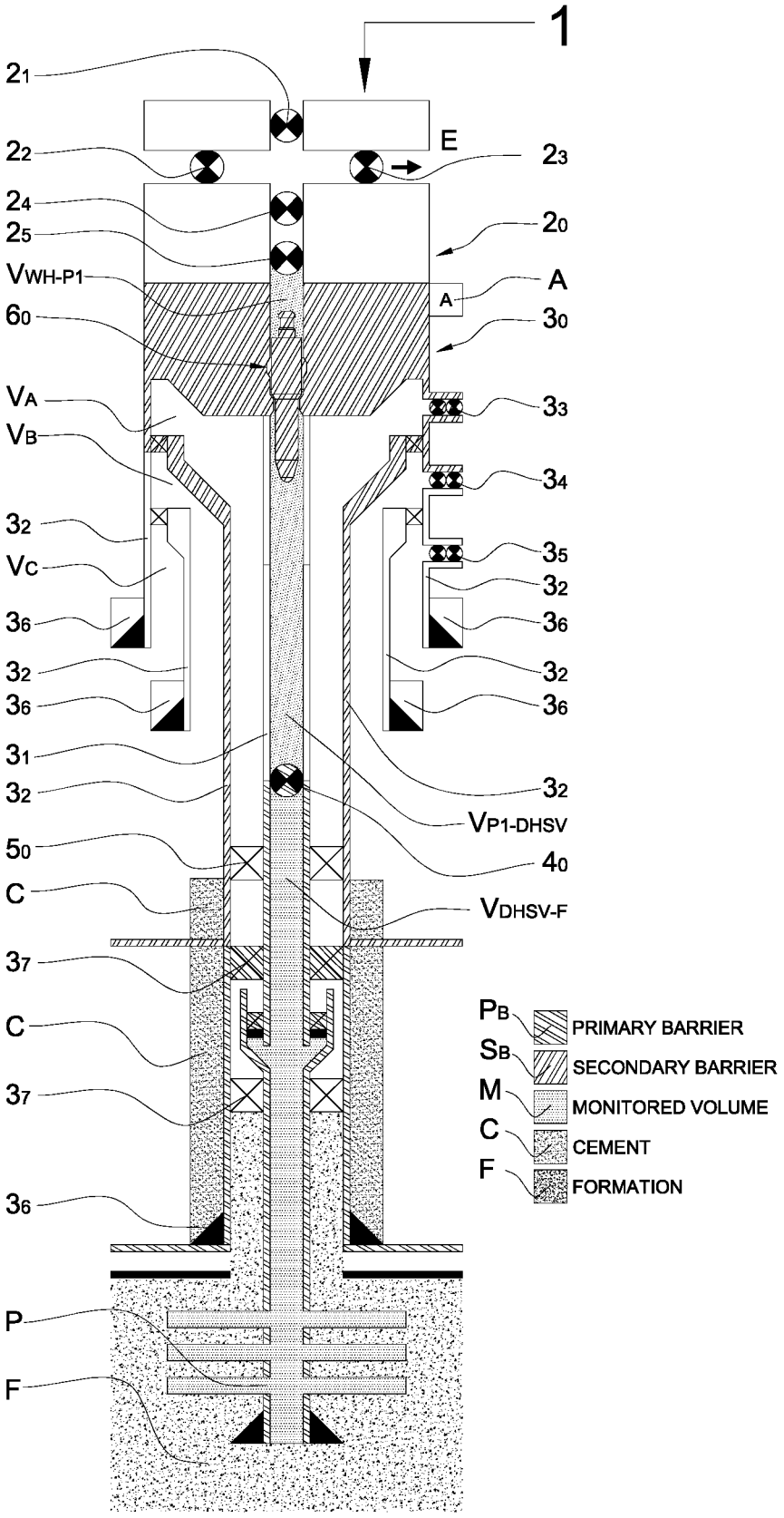
FIG. 3 shows a schematic representation of the production well having been suspended by closing a downhole safety valve and by setting a shallow-set plug above the downhole safety valve.

FIG. 3 shows the production well (1) having been suspended according to the invention by closing the downhole safety valve ($\mathbf{4}_0$) and setting a shallow-set first plug ($\mathbf{6}_0$) above the downhole safety valve ($\mathbf{4}_0$), in addition to closing the production master valve ($\mathbf{2}_3$), the hydraulic master valve ($\mathbf{2}_4$) and the manual master valve ($\mathbf{2}_5$). The first plug ($\mathbf{6}_0$) is instrumented and has instrumentation for obtaining information by measuring physical characteristics below the plug (not shown) and means for transmitting said obtained information to an operator (not shown). By use of the instrumentation of the first plug ($\mathbf{6}_0$), a third chamber ($V_{P1\text{-}DHSV}$), between the first plug ($\mathbf{6}_0$) and the downhole safety valve ($\mathbf{4}_0$), can be monitored, in addition to a first chamber ($V_{WH\text{-}P1}$), between the first plug ($\mathbf{6}_0$) and the manual master valve ($\mathbf{2}_5$), and a fourth chamber ($V_{DHSV\text{-}F}$) between the downhole safety valve ($\mathbf{4}_0$) and the formation (F). Monitoring of the fourth chamber ($V_{DHSV\text{-}F}$) is made possible by use of a downhole pressure gauge (not shown) or tubing-to-annulus communication, or through metering below the first plug ($\mathbf{6}_0$) through normal static condition leakage through the closed downhole safety valve ($\mathbf{4}_0$).

Figure 4:
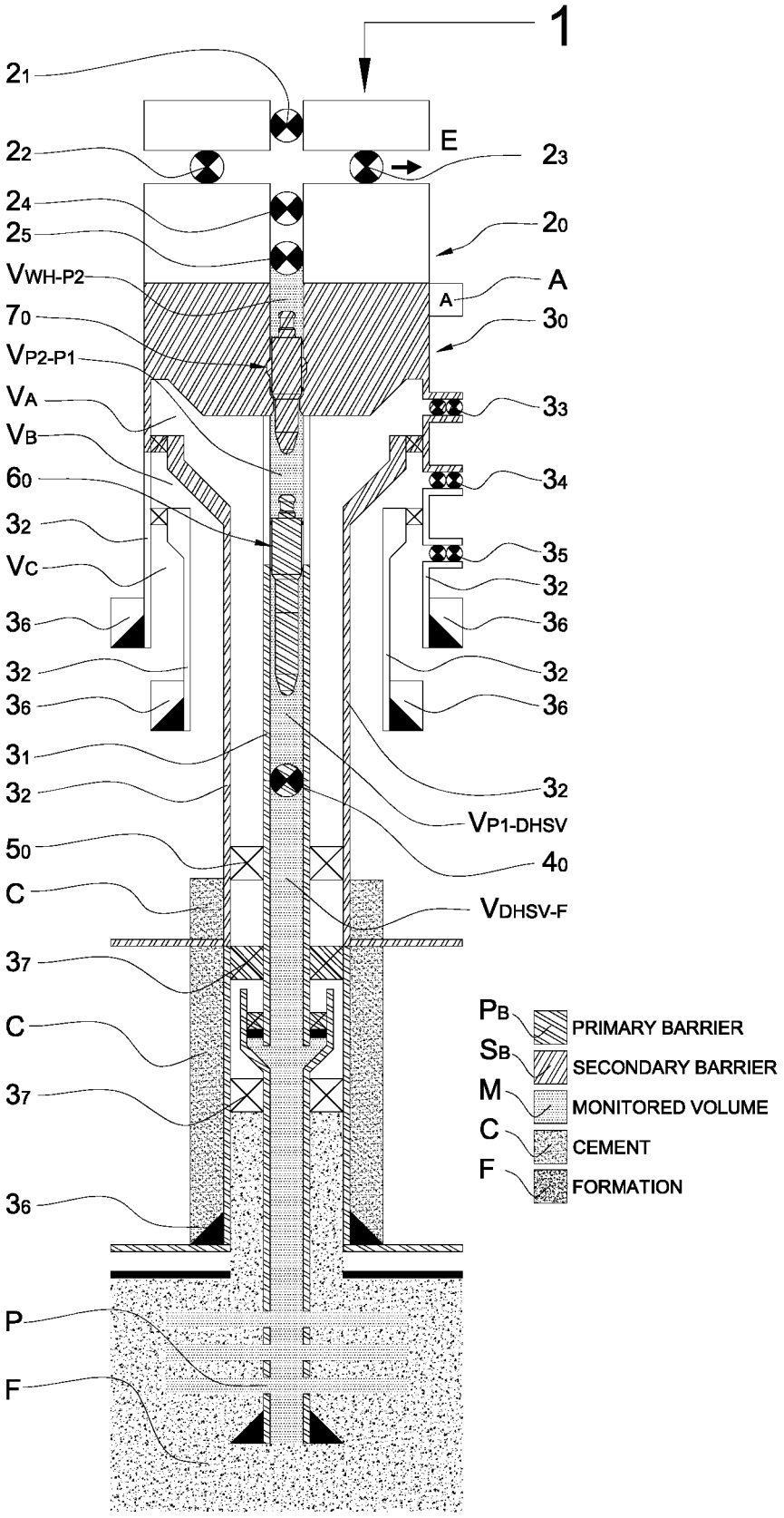
FIG. 4 shows a schematic representation of the production well having been suspended by closing the downhole safety valve, setting a first shallow-set plug above the downhole safety valve, and setting a second shallow-set plug above the first plug.

FIG. 4 shows the production well (1) having been suspended according to the invention by closing the downhole safety valve ($\mathbf{4}_0$), setting a shallow-set first plug ($\mathbf{6}_0$) above the downhole safety valve ($\mathbf{4}_0$), and setting a shallow-set second plug ($7_0$) above the first plug ($6_0$). In addition, the production master valve ($2_3$), the hydraulic master valve ($2_4$) and the manual master valve ($2_5$) have been closed. Setting a shallow plug may be done by use of a lubricator tool. In this embodiment, the monitored chambers (M) include the first chamber ($V_{WH-P2}$) between the second plug ($7_0$) and the manual master valve ($2_5$), a fifth chamber ($V_{P2-P1}$) between the second plug ($7_0$) and the first plug ($6_0$), the third chamber ($V_{P1-DHSV}$) between the first plug ($6_0$) and the downhole safety valve ($4_0$), and the fourth chamber ($V_{DHSV-F}$) between the downhole safety valve ($4_0$) and the formation (F). The first chamber ($V_{WH-P2}$) and the fifth chamber ($V_{P2-P1}$) are monitored using instrumentation (not shown) included in the second plug ($7_0$), the third chamber ($V_{P1-DHSV}$) is monitored using instrumentation (not shown) included in the first plug ($6_0$), and the fourth chamber is monitored by use of a downhole pressure gauge (not shown).

Figure 5:
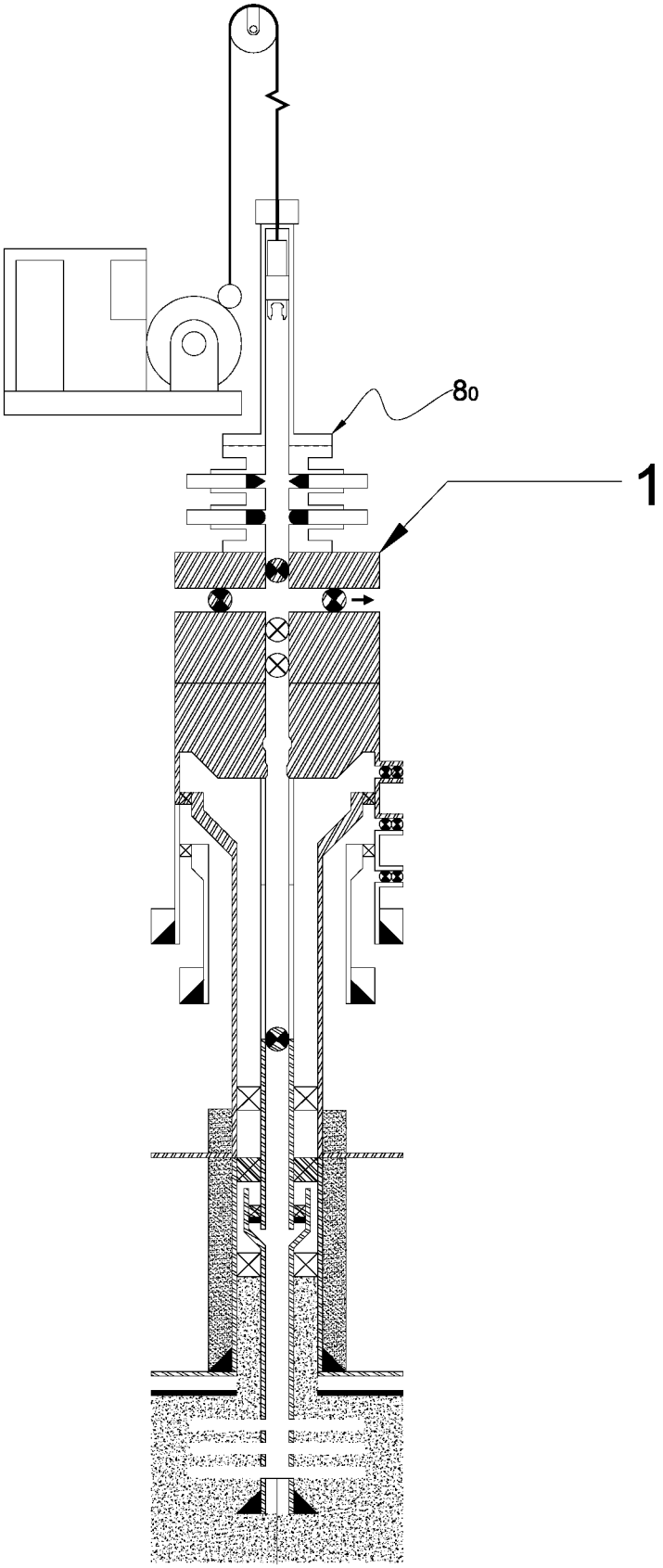
FIG. 5 shows a schematic representation of the production well prepared for wireline intervention.

FIG. 5 shows the production well (1) prepared for wireline ($8_0$) intervention. The primary barrier ($P_B$) is maintained while the downhole safety valve ($4_0$) remains in a closed position. The secondary barrier ($S_B$) is maintained with the swab valve ($2_1$) in a closed position, or with the swab valve ($2_1$) in an open position when the wireline unit ($8_0$) forms part of the secondary barrier ($S_B$) envelope following a pressure test.

Figure 6:
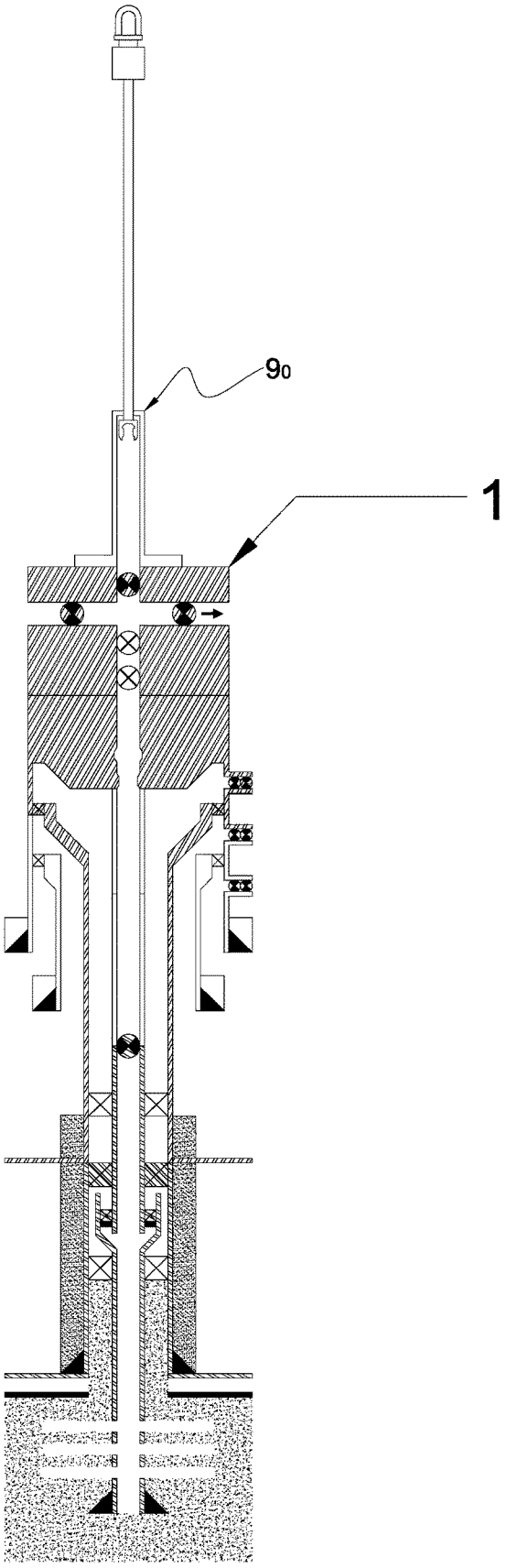
FIG. 6 shows a schematic representation of the production well prepared for lubricator intervention.

FIG. 6 shows the production well (1) prepared for lubricator tool ($9_0$) intervention. The primary barrier ($P_B$) is maintained while the downhole safety valve ($4_0$) remains in a closed position. The secondary barrier ($S_B$) is maintained with the swab valve ($2_1$) in a closed position, or with the swab valve ($2_1$) in an open position when the lubricator tool ($9_0$) forms part of the secondary barrier ($S_B$) envelope following a pressure test.

FIG. 7*a* shows a mechanical plug ($10_0$) with two seals ($10_1$), which when actuated, seals and separates the volume of the production tubular ($3_1$) above the plug ($10_0$) from that which is below the plug ($10_0$). The plug ($10_0$) may be mechanically locked in its position by means of a locking device ($10_2$) which may intrude into the production tubular ($3_1$) or equivalent devices designed to fit into a groove in the production tubular ($3_1$). Such a mechanical plug ($10_0$) may have multiple sealing elements sealing and separating the volume of the production tubular ($3_1$) above the plug ($10_0$) from that which is below the plug ($10_0$).

The mechanical plug ($10_0$) is also equipped with an instrument section ($10_4$) which in this example has been adapted to fit between the mechanical plug's ($10_0$) main body and its bull nose ($10_3$) mounted at its lower end. The instrument section ($10_4$) may have fluid connection with borehole chambers above and/or below the plug ($10_0$) and may form the pressure retaining element of the plug ($10_0$), separating the two chambers. The instrument section ($10_4$) may contain instrumentation for obtaining information by measuring physical characteristics in a fluid above and/or a fluid below the plug ($10_0$) such as pressure, temperature, density etc. and means of transmitting said information by use of commonly known methods such as transmitting information acoustically through a tubular wall, transmitting information electromagnetically etc. from within the borehole to a location within or outside of the borehole and made available to an operator. The information may typically include pressure above the plug ($P_2$), temperature above the plug ($T_2$), pressure below the plug ($P_1$), temperature below the plug ($T_1$) and physical characteristics such as density ($\rho_1$) or other characteristics allowing determination of fluid type (gas, crude oil, brine, water etc.) and if plural ($\rho_1$, $\rho_2$ or more) allowing determination of rate of change ($Q_1$) ($cm^3$/min) and thus flow/inflow. The following plugs from preceding figures are of this type: FIG. 3—plug ($6_0$) and FIG. 4—plug ($6_0$).

FIG. 7*b* shows a mechanical plug (11) with seals ($11_1$), which when actuated, seals and separates a chamber of the production tubular ($3_1$) above the plug from a chamber below the plug ($11_0$). The plug ($11_0$) may be mechanically locked in its position by means of a locking device ($11_2$) which may intrude into the production tubular ($3_1$) or equivalent devices designed to fit into a groove in the production tubular ($3_1$). The following plugs from preceding figures may be of this type: FIG. 2—plug ($6_0$) and plug ($7_0$), FIG. 4—plug ($7_0$).

FIG. 7*c* shows a mechanical plug assembly ($12_0$) with one locking device ($12_4$), a first sealing body ($12_1$) and a second sealing body ($12_2$), each with seals ($12_3$). When the seals of the sealing bodies ($12_1$, $12_2$) are actuated, they seal and separate a chamber in the production tubular ($3_1$) above the first sealing body ($12_1$) from a chamber in the production tubular ($3_1$) below the first sealing body ($12_1$), and a chamber of the production tubular ($3_1$) below the second sealing body ($12_2$) from a chamber of the production tubular ($3_1$) above the second sealing body ($12_2$), and forms an enclosed chamber between the first sealing body ($12_1$) and the second sealing body ($12_2$). Each of the chambers may be monitored by instrumentation ($12_6$) included in the plug assembly ($12_0$). The plug assembly ($12_0$) is made such that it may be set in a single run.

FIG. 7*d* Illustrates a second embodiment of the mechanical plug assembly ($13_0$) with a first locking device ($13_4$) and a second locking device ($13_5$) and a first sealing body ($13_1$) and a second sealing body ($13_2$). Each sealing body ($13_1$, $13_2$) comprises seals ($13_3$). When actuated, the seals of the first sealing body ($13_1$) seal and separate a chamber of the production tubular ($3_1$) above the first sealing body ($13_1$) from a chamber of the production tubular ($3_1$), and the seals of the second sealing body ($13_2$) seal and separate a chamber of the production tubular ($3_1$) below the second sealing body ($13_2$) from a chamber of the production tubular ($3_1$) above the second sealing body ($13_2$). The sealing bodies ($13_1$, $13_2$) further forms a chamber between the upper sealing body ($13_1$) and the lower sealing body ($13_2$). Each of the volumes, above the upper sealing body ($13_1$), below the lower sealing body ($13_2$) and between the sealing bodies ($13_1$) and ($13_2$) may be monitored by instrumentation ($13_6$) included in the plug assembly ($13_0$). The mechanical plug assembly ($13_0$) is arranged with a mechanical connection ($13_8$) connecting the first sealing body ($13_1$) and first locking device ($13_4$) with the second sealing body ($13_2$) and second locking device ($13_5$). The plug assembly is made such that it may activate both locking devices ($13_4$, $13_5$) and all seals ($13_3$) in a single run.

The plug ($10_0$) shown in FIG. 7*a* and the plug assemblies ($12_0$, $13_0$) shown in FIG. 7*c* and in FIG. 7*d* are possible embodiments of the apparatus according to the second aspect of the invention. The plug assemblies shown in FIG. 7*c* and in FIG. 7*d* may be referred to as tandem plugs.

For both a lubricator tool and a wireline unit the top of the lubricator assembly includes high-pressure grease-injection section and sealing elements. The lubricator is installed on top of the Christmas tree and tested, the plug is placed in the lubricator and the lubricator is pressurized to wellbore pressure. Then the top valves of the Christmas tree are opened to enable the plug to be guided mechanically, to fall or to be pumped into the wellbore under pressure. To remove the tools, the reverse process is used: the plug is pulled up into the lubricator under wellbore pressure, the Christmas tree valves are closed, the lubricator pressure is bled off, and the lubricator may be opened to remove the plug.

FIG. 1 shows a well (1) in normal production mode. FIG. 2 shows the same well (1) suspended according to methodology known from prior art. The deep-set first plug ($\mathbf{6}_0$) and the shallow-set second plug ($\mathbf{7}_0$) in FIG. 2 are placed by use of a wireline unit ($\mathbf{8}_0$), such as illustrated in FIG. 5, while the kill valve ($\mathbf{2}_2$) and the production master valve ($\mathbf{2}_3$) are closed and the swab valve ($\mathbf{2}_1$), the hydraulic master valve ($\mathbf{2}_4$), the manual master valve ($\mathbf{2}_5$) and the downhole safety valve ($\mathbf{4}_0$) are open, as required for lowering/hoisting the wireline and connected tools/plugs.

In a first embodiment the invention relates to a method of suspending a production well (1) different from prior art practice in the petroleum industry which involves setting a deep-set plug ($\mathbf{6}_0$) and a shallow-set plug ($\mathbf{7}_0$) as illustrated in FIG. 2, and instead setting a shallow-set plug ($\mathbf{6}_0$) as illustrated in FIG. 3 arranged with instrumentation to sufficiently monitor fluid characteristics in chambers of the production tubular ($\mathbf{3}_1$) above the plug ($V_{WH\text{-}P1}$) and below the plug ($V_{P1\text{-}DHSV}$) extending to the downhole safety valve ($\mathbf{4}_0$). In this embodiment the downhole safety valve ($\mathbf{4}_0$) forms part of the primary barrier ($P_B$) and the plug ($\mathbf{6}_0$) forms part of the secondary barrier ($S_B$).

In a second embodiment, shown in FIG. 4, the method according to the invention involves suspending the well (1) by use of a first shallow-set plug ($\mathbf{6}_0$) and a second shallow-set plug ($\mathbf{7}_0$) incorporating sufficient instrumentation to measure physical characteristics in chambers ($V_{P2\text{-}P1}$, $V_{P1\text{-}DHSV}$) in the production tubular ($\mathbf{3}_1$). In this embodiment the downhole safety valve ($\mathbf{4}_0$) and the first plug ($\mathbf{6}_0$) form part of the primary barrier ($P_B$) and the second plug ($\mathbf{7}_0$) forms part of the secondary barrier ($S_B$).

In both embodiments of the method according to the first aspect of the invention, the statutory barrier requirements are fulfilled, however the first embodiment depends upon the quality and state of the downhole safety valve ($\mathbf{4}_0$) and presence of pressure status monitoring of the volume below the downhole safety valve ($\mathbf{4}_0$). In the second embodiment the downhole safety valve ($\mathbf{4}_0$) supported by the first plug ($\mathbf{6}_0$) form the primary barrier ($P_B$) and provides as a minimum pressure monitoring of the chamber ($V_{P1\text{-}DHSV}$) below the downhole safety valve ($\mathbf{4}_0$).

The first chamber ($V_{WH\text{-}P1}$) in FIG. 3 and the first chamber ($V_{WH\text{-}P2}$) in FIG. 2 and FIG. 4, above the uppermost plug, may otherwise usually be monitored by Christmas tree-mounted instrumentation. The second chamber ($V_{DHSV\text{-}P1}$) in FIG. 2, the fourth chamber ($V_{DHSV\text{-}F}$) in FIG. 3 and FIG. 4, below the downhole safety valve (40), may be monitored by a downhole gauge if installed, or by static monitoring through leakage across the downhole safety valve ($\mathbf{4}_0$).

In both the first and the second embodiments as illustrated in FIGS. 3, 4 and 5 the plug ($\mathbf{6}_0$) or plugs ($\mathbf{6}_0$, $\mathbf{7}_0$) may be set and retrieved by use of a lubricator tool ($\mathbf{9}_0$) such as illustrated in FIG. 6. When pressure tested and connected to the Christmas tree ($\mathbf{2}_0$) the lubricator tool ($\mathbf{9}_0$) may form part of the secondary barrier ($S_B$). As neither the first or second embodiment require opening of the downhole safety valve ($\mathbf{4}_0$) it is possible to maintain a primary barrier ($P_B$) and a secondary barrier ($S_B$) at all times during well suspension operations leading to further enhanced safety versus conventional suspension.

In both embodiments the first plug ($\mathbf{6}_0$) is instrumented such as illustrated in FIG. 7*a* ($\mathbf{10}_0$) enabling measurement of pressure ($P_2$) and temperature ($T_2$) above the plug ($\mathbf{10}_0$) and pressure ($P_1$), temperature ($T_1$) and density ($\rho_1$) below the plug. The plug ($\mathbf{10}_0$) is equipped with a locking device ($\mathbf{10}_2$) which mechanically locks the plug ($\mathbf{10}_0$) to the tubular ($\mathbf{3}_1$). The locking may take form of teeth in the locking device ($\mathbf{10}_2$) intruding into the tubular ($\mathbf{3}_1$) wall, or take form of a profile which enters into an equivalent groove in the tubular or wellhead. The plug ($\mathbf{10}_0$) is equipped with seals ($\mathbf{10}_1$) which seal the void between the plug ($\mathbf{10}_0$) and the tubular ($\mathbf{3}_1$) when activated.

The second plug ($\mathbf{7}_0$) may be a non-instrumented plug such as illustrated in FIG. 7*b* ($\mathbf{11}_0$). However, both plugs may be instrumented allowing metering of physical characteristics above, below and/or between the plugs (60, 70), in any relevant combination.

The instrumented plug ($\mathbf{10}_0$) in FIG. 7*a*, or the first plug ($\mathbf{6}_0$) in FIGS. 3 and 4, contains an instrument section which may be removable and adapted to most types of plugs without mechanical reworking, e.g. by removing the bullnose ($\mathbf{10}_3$), attaching the instrument section ($\mathbf{10}_4$) to the plug ($\mathbf{10}_0$) in place of the bullnose ($\mathbf{10}_3$) and, if needed, reattaching the bullnose ($\mathbf{10}_3$) to the instrument section ($\mathbf{10}_4$) thereby obtaining a similar but elongated version of a non-instrumented plug ($\mathbf{11}_0$).

The instrument section ($\mathbf{10}_4$) may contain energy storage devices, logic processing units, electronic circuitry and arrangements for transmitting and/or receiving data to/from an opposite control unit (A) located inside or outside the production tubular ($\mathbf{3}_1$), or outside the well in the surrounding environment (E). Data may be transmitted, in one or both directions and an operator may transmit a command initiating a specific action, conversely the plug ($\mathbf{10}_0$) may be equipped with actuation devices such as valves, perforation charges etc. which may be actuated from the control unit (A).

Communication may be acoustic or electromagnetic or by any other means of communication such as disclosed in general literature and in other patents and will not be further discussed herein.

When using plugs ($\mathbf{10}_0$, $\mathbf{11}_0$) such as illustrated in FIGS. 7*a* and 7*b* each plug ($\mathbf{10}_0$, $\mathbf{11}_0$) needs to be set in a separate run. I.e. a lower plug ($\mathbf{10}_0$, $\mathbf{11}_0$) must be set in place, thereafter the tool used to set the plug ($\mathbf{10}_0$, $\mathbf{11}_0$) must be retracted and connected to the upper plug ($\mathbf{10}_0$, $\mathbf{11}_0$) before setting this, meaning that two separate tool runs are required.

Equal barrier protection and functionality may be achieved by use of special plugs with one or more barriers or one or more plugs mechanically connected each with one or more barriers, in any relevant combination with each other or with plugs ($\mathbf{10}_0$, $\mathbf{11}_0$) as illustrated in FIGS. 7*a* and 7*b*.

The plugs ($\mathbf{10}_0$, $\mathbf{11}_0$, $\mathbf{12}_0$, $\mathbf{13}_0$) as described may find use in other applications and shall not be limited by the method described herein.

The invention claimed is:

1. A method of suspending flow of a well fluid in a well, wherein the well is completed, the method comprising:

providing a production tubular in an upper wellhead section;

providing a downhole safety valve in an opened position in the production tubular, wherein the opened position permits the flow of the well fluid during a producing phase of the well;

providing a production master valve in the opened position in the production tubular upstream of the downhole safety valve, wherein the downhole safety valve and the production master valve define a shallow region of the production tubular;

actuating the downhole safety valve from the opened position to a closed position such that flow of the well fluid through the downhole safety valve is arrested;

placing a first plug in the shallow region of the production tubular by passing the first plug through the production master valve, wherein the first plug is:

adapted to directly contact the production tubular to form a barrier for containing the well fluid;

equipped with instrumentation for obtaining information by measuring physical characteristics below the first plug; and equipped with means for transmitting said obtained information to an operator.

2. The method according to claim 1, wherein the well is a producing well.

3. The method according to claim 1, wherein the method further comprises the step of obtaining information on the characteristics of a fluid in the well by use of the instrumentation for obtaining information of the first plug.

4. The method according to claim 3, wherein the step of obtaining information on the characteristics of a fluid in the well comprises the step of obtaining information on the characteristics of a fluid in a chamber of the well below the first plug, and in a chamber of the well above the first plug.

5. The method according to claim 1, wherein the method further comprises setting a second plug above the first plug.

6. The method according to claim 5, wherein the second plug is equipped with instrumentation for obtaining information by measuring physical characteristics below and above the second plug; and equipped with means for transmitting said obtained information to an operator.

7. The method according to claim 1, wherein the method further comprises the step of obtaining information on the characteristics of a fluid in a chamber of the well between the first plug and the second plug and above the second plug by use of the instrumentation for obtaining information of the second plug.

8. The method according to claim 1, wherein the method comprises the step of transferring information to and from the first plug and the second plug from and to an operator.

9. The method according to claim 1, wherein the method comprises the step of connecting a lubricator to the well, and wherein the step of placing a first plug in the production tubular comprises the step of using the lubricator to place the first plug in the well.

10. The method according to claim 1, wherein the first plug is the first plug to be set as part of the method of suspending flow in the well.

11. A method of suspending flow in a petroleum producing well, wherein the method comprises:

placing at least one plug in a production tubular in an upper wellhead section above a downhole safety valve that is located in the production tubular and through which well fluids flow during a producing phase of the well, wherein the at least one plug comprises:

a nose section;

an instrument section coupled to an upstream end of the nose section, wherein the instrument section comprises a plurality of locking devices configured to extend radially outwardly from the instrument section and directly intrude into the production tubular to lock a position of the plug, and wherein the instrument section is equipped with instrumentation for measuring physical characteristics below the plug and means for transmitting such information to an operator and wherein the at least one plug forms part of a secondary barrier containing the well fluids; and a plug section coupled to an upstream end of the instrument section, wherein the plug section comprises at least one seal member configured to directly contact the production tubular to form a barrier for containing well fluid;

communicating with the plug instrumentation using a control unit located inside or outside of the production tubular and making the information transmitted from the plug available to an operator.

12. The method according to claim 11 where a second plug is set in the tubular above the first plug and where the first plug forms part of a primary barrier and where the second plug forms part of a secondary barrier containing the well fluids.

13. The method according to claim 11 where the method of transferring information from the plug to or from an operator is by means of acoustic signaling.

14. The method according to claim 11 where the method of transferring information from a plug to or from an operator is by means of electromagnetic signaling.

15. The method according to claim 11 where communication between a control unit (A) and a plug is achieved by the control unit (A), or part of a control unit being lowered into the well inside the tubular.

16. The method according to claim 11 where the physical characteristics include fluid pressure.

17. The method according to claim 11 where the physical characteristics includes fluid temperature.

18. The method according to claim 11 where the physical characteristics includes fluid type determined by fluid density, viscosity, pH, conductivity, resistivity or refractive index.

19. The method according to claim 11 where the method of setting and retrieving the first plug and the secondary plug is by use of a lubricator tool.

20. The method according to claim 12, where the first plug and the second plug are mechanically connected allowing setting or retrieval of both plugs in a single well entry operation.

21. An apparatus for suspending flow in a well, the apparatus comprising:

a first plug and a second plug, each comprising:

a nose section;

an instrument section coupled to an upstream end of the nose section; wherein the instrument section comprises a plurality of locking devices configured to extend radially outwardly from the instrument section and directly intrude into a production tubular to lock a position of the plug, and wherein the instrument section is equipped with instrumentation for obtaining information by measuring physical characteristics in theft well and means for transmitting said information to an operator; and a plug section coupled to an upstream end of the instrument section, wherein the plug section comprises at least one seal member configured to directly contact the production tubular to form a barrier for containing well fluid;

a cylindrical connector member that couples the first plug to the second plug and allows setting or retrieval of both plugs in a single well entry operation;

wherein the instrumentation of at least one of the first plug or the second plug is configured to measure physical characteristics of the well in a sealed region surrounding the cylindrical connector between the first plug and the second plug.

22. The apparatus according to claim 21, wherein the instrumentation for obtaining information by measuring physical characteristics of the first plug and the second plug comprise instrumentation for obtaining information by measuring physical characteristics below the plug in operational use.

23. The apparatus according to claim 21, wherein the cylindrical connector member has a smaller diameter than the first plug and the second plug, such that the cylindrical connector member defines a chamber in the well between the first plug and the second plug when the apparatus is in operational use.

24. The apparatus according to claim 21, wherein the first plug and the second plug are mechanical tubular plugs.

25. The apparatus according to claim 21, wherein the first plug and the second plug comprises instrumentation for receiving a command from an operator and configured to be actuated upon receiving a command from the operator.

* * * * *